8-108.1 SR
F6966 XR 3,960,744

United States Patent [19]
Homma et al.

[11] 3,960,744
[45] June 1, 1976

[54] POWDER DETERGENT COMPOSITION

[75] Inventors: Itomi Homma, Funabashi; Junryo Mino, Kamagaya; Kenzo Kunikawa, Wakayama, all of Japan

[73] Assignee: Kao Soap Co., Ltd., Tokyo, Japan

[22] Filed: Nov. 27, 1974

[21] Appl. No.: 527,878

[30] Foreign Application Priority Data

Nov. 29, 1973 Japan ..... 48-134511

[52] U.S. Cl. ..... 252/102; 8/77; 8/108 R; 8/137; 252/95; 252/99

[51] Int. Cl.[2] ..... C11D 7/54

[58] Field of Search ..... 252/102, 95, 99; 8/108, 8/77, 137

[56] References Cited

UNITED STATES PATENTS 3,748,093 7/1973 Gangwisch et al. ..... 8/137 X

*Primary Examiner*—Mayer Weinblatt
*Attorney, Agent, or Firm*—Woodhams, Blanchard and Flynn

[57] ABSTRACT

A powder detergent composition comprising as main ingredients a surface active agent and an inorganic builder and/or an organic builder, characterized in that the composition also contains at least one bluing dye precursor having the formula (1)

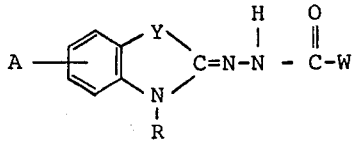

(1)

wherein A is hydrogen, halogen, $-CH_3$, $-OCH_3$, $-SO_3H$ or $-SO_3Na$, Y is -S-, -O-,

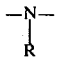

or -C=C-, R is methyl or ethyl, and W is

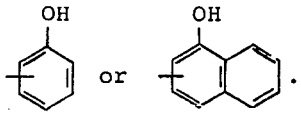

The composition can also contain at least one active halogen-generating agent.

6 Claims, No Drawings

POWDER DETERGENT COMPOSITION

BACKGROUND OF THE INVENTION

1. Field of the Invention

This invention relates to a powder detergent composition. More particularly, this invention relates to a powder detergent composition which has a high whiteness without coloration in the powder state and which can blue an article during the washing treatment thereof thereby to attain a highly improved whitening effect.

2. Description of the Prior Art

It is well known in the detergent art that a whitening effect can be attained by incorporating in fabric-washing detergent compositions a so-called bluing agent and dyeing the washed article with a faint blue color (a so-called bluing treatment). The color tone of these bluing agents for imparting the whitening effect to washed articles is not a pure blue, but rather is of a slightly reddish violet color. Therefore, if such a bluing agent is directly blended in a powder detergent, the detergent is slightly colored red because of the inherent color property of the bluing agent, and the desired pure white color and fresh appearance of the detergent are drastically lowered. In order to avoid this undesired coloration phenomenon, it is necessary to coat the bluing agent or the like so that its color is masked or concealed.

Further, the whitening effect of the bluing agent can result in a reduction of the whiteness if an excessive amount thereof is used, and such undesired phenomena as spot dyeing of fibers owing to uneven application of the detergent can occur. In order to prevent occurrence of such undesired phenomena, the absorbability (absorption) of the dye is generally controlled by various means. This control treatment in turn causes the problem that not all of the added dye is effectively utilized and, in extreme cases, the majority of the dye is not absorbed by the fibers, but rather is discharged together with waste water, as occurs with pigment-type bluing agents. Still further, even though the amount of dye absorption is controlled with currently available bluing agents, because the principal purpose of using bluing agents is to overcome yellowing of clothes by using a dye of a complementary color, when washing is repeated over a long period, reduction of the color clarity or whiteness of the fabrics cannot be avoided. Moreover, for some bluing agents, because of the inherent properties of the dye or the method of compounding it in the detergent composition, the dye is decomposed during storage of the powder detergent and it fails to exhibit its intended activity, or the dye when dissolved in water is scarcely absorbed in the fibers but rather adheres to the tank of the washing machine to make it dirty.

SUMMARY OF THE INVENTION

According to this invention, the foregoing problems are overcome by providing a powdery detergent composition comprising as main ingredients a surfactant and an inorganic builder and/or an organic builder, wherein the composition contains at least one bluing dye precursor having the formula (1)

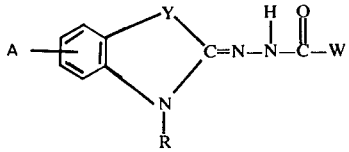

(1)

wherein A is hydrogen, halogen, $-CH_3$, $-OCH_3$, $-SO_3H$ or $-SO_3Na$, Y is —S—, —O—,

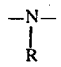

or —C=C—, R is methyl or ethyl, and W is

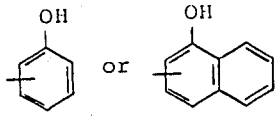

In another preferred detergent composition, there is contained said bluing dye precursor and at least one halogen-generating agent.

The bluing dye precursor of the above formula (1) is colorless or scarcely colored. Under oxidative conditions, it is converted to an azo dye of the blue color type.

As specific examples of the bluing dye precursor used in this invention, there can be mentioned 3-methyl-2-benzothiazolinone-1′-hydroxy-2′-naphthoylhydrazone, 1-ethyl-2-quinolinone-2′-hydroxybenzoylhydrazone, 1,3-dimethyl-2-benzimidazolone-1′-hydroxy-2′-naphthoylhydrazone, 3-methyl-2-methylbenzoxazolone-2′-hydroxybenzoylhydrazone, 3-methyl-2-benzothiazolinone-2′-hydroxybenzoylhydrazone, x-sulfo-3-methyl-2-benzothiazolinone-1′-hydroxy-2′-naphthoylhydrazone, 3-methyl-2-benzothiazolinone-2′-hydroxy-3′-naphthoylhydrazone, 5-chloro-3-methyl-2-benzothiazolinone-1′-hydroxy-2′-naphthoyl-hydrazone, 1,3,5-trimethyl-2-benzimidazolone-1′-hydroxy-2′-naphthoylhydrazone, 1-ethyl-6-methoxy-2-quinoline-2′-hydroxy-benzoylhydrazone, and the like.

The term "active halogen-generating agent" used in this specification and claims means a substance that can be dissolved in water and can generate an active halogen (cationic halogen) in an aqueous solution. As the preferred active halogen-generating agent that can be used in this invention, there can be mentioned an N-halogen derivatives capable of generating an active halogen directly when dissolved in water and a compound capable of releasing an active chlorine atom on reaction with sodium chloride. Examples of the former active halogen-generating agents include N-halogenated isocyanuric acid salts, N-halogenated succinimides, N-halogenated phthalimides, N-halogenated acetanilides, N-halogenated benzamides, N-halogenated benzenesulfonamides, N-halogenated toluenesulfonamides, N-halogenated N-arylsulfonyl-3-aminopropane-1-sulfonic acid salts, N-halogenated N-alkylsulfonyl-3-aminopropane-1-sulfonic acid salts, and the like. As an example of the latter active halogen-generating agent, there can be mentioned a mixture of potassium persulfate and sodium chloride.

The detergent composition of this invention is prepared by blending the above-mentioned bluing dye precursor and, optionally, the above-mentioned active halogen-generating agent into a conventional fabric-washing detergent compositions. Such compositions comprise a surfactant and inorganic builders and/or organic builders as principal ingredients, as is well known. As the organic surfactants, there can be mentioned, for example, anionic surfactants such as alkylbenzene-sulfonic acid salts, α-olefin-sulfonic acid salts, alkane-sulfonic acid salts, alkylsulfuric acid salts, alkylpolyoxyethylene-sulfuric acid salts and alkylcarboxylic acid salts, non-ionic surfactants such as polyoxyethylene alkyl ethers, polyoxyethylene ethers and polyoxyethylene polyol ethers, and amphoteric surfactants such as N-alkylbetaines. These surfactants can be used singly or in the form of mixtures of two or more of them. As the builders for increasing the washing power of the surfactants, there can be mentioned condensed phosphoric acid salts such as tripolyphosphoric acid salts, trimetaphosphoric acid salts and pyrophosphoric acid salts, polycarboxylic acid salts such as citric acid salts, tartaric acid salts, malic acid salts, diglycolic acid salts, succinic acid salts, trimesic acid salts and pyromellitic acid salts, chelating agents such as nitrilotriacetic acid salts, ethylenediamine-tetraacetic acid salts, iminodiacetic acid salts and hydroxyethyliminodiacetic acid salts, water-soluble high molecular weight compounds such as polyethylene glycol, polyvinylpyrrolidone and water-soluble hydrolyzates of copolymers of maleic anhydride with a vinyl compound (such as methylvinyl ether, vinyl acetate, isoprene and butylene), and inorganic metal salts such as carbonates, silicates, sulfates and borates.

A fluorescent dye can be incorporated into the powder detergent of this invention. In this case, owing to the synergistic activity of the fluorescent dye and the bluing dye precursor, a further improved whitening effect can be attained. As the fluorescent dye that can be used in this invention, there can be mentioned, for example, diaminostilbene derivatives, distilbene derivatives, coumarin derivatives, and imidazolone derivatives.

The bluing dye precursor of the formula (1) used in this invention is colorless, and unlike conventional powder detergents having a dye or pigment incorporated therein as a bluing agent, the powder detergent composition of this invention containing such bluing dye precursor is not colored by the dye precursor and the detergent powder per se has an excellent whiteness. Further, the dye precursor is readily absorbed in fibers and causes coloring reaction after it has been absorbed in fibers. Accordingly, a sufficient bluing effect can be attained by the use of a small amount of the dye precursor.

The amount of bluing dye precursor of formula (1) blended in the detergent composition is an amount effective to deposit on the washed fabric an amount of said precursor to overcome yellowing of the fabrics. It is preferred to use from 0.001 to 0.5 percent by weight, especially from 0.002 to 0.1 percent by weight, of said precursor, based on the total weight of the powder detergent composition.

When only the bluing dye precursor of formula (1) is incorporated in the detergent composition, without using an active halogen-generating agent, during the washing process inclusive of the rinsing step, that precursor is gradually colored by the chlorine contained in chlorinated city service water to exhibit a bluing effect. Further, when the washed article is ironed or exposed to sun light, the dye precursor of formula (1) is gradually oxidized to exhibit a bluing effect.

In case both a bluing dye precursor of formula (1) and an active halogen-generating agent are blended in the powder detergent composition, the dye precursor does not become colored as long as the composition is in a powder state, but during washing or after passage of a certain period thereafter, the bluing dye precursor is oxidized and colored by the active halogen-generating agent to exhibit a bluing effect.

The amount of the active halogen-generating agent blended in the detergent composition is an amount effective to transform the bluing dye precursor therein to a blue dye. It is preferred to use from 0.001 to 1.0 percent by weight, especially 0.005 to 0.5 percent by weight, of said active halogen generating agent, based on the total weight of the detergent composition.

Moreover, if the detergent composition contains only the bluing dye precursor, it is possible to color the dye precursor completely by dipping the washed article in an aqueous solution of an active halogen-generating agent after the washing treatment.

Further, a washed article blued by the detergent composition of this invention can easily be decolorized by a commercially available bleaching agent comprising sodium hypochlorite, and therefore, the harmful influence due to accumulated absorption of the bluing component by repeated use of the detergent composition can be effectively prevented.

This invention will now be further described by reference to the following illustrative Examples, in which all "parts" are parts by weight.

EXAMPLE 1

| | |
|---|---|
| Sodium linear-alkylbenzenesulfonate (average carbon number in the alkyl group being 12) | 20 parts |
| Sodium tripolyphosphate | 20 parts |
| Sodium silicate | 5 parts |
| Sodium carbonate | 2 parts |
| Sodium carboxymethyl cellulose | 1 part |
| Soap | 1 part |
| Fluorescent dye (sodium distilbene-2,2-disulfonate) | 0.06 part |
| Water | 10 parts |
| Sodium sulfate | 40.94 parts |

A fabric washing detergent composition for household use composed of the above ingredients was spray-dried to obtain a powdery detergent (detergent A).

A mixture of 99.99 parts of the above washing detergent composition A and 0.01 part of a known bluing dye having the formula (2)

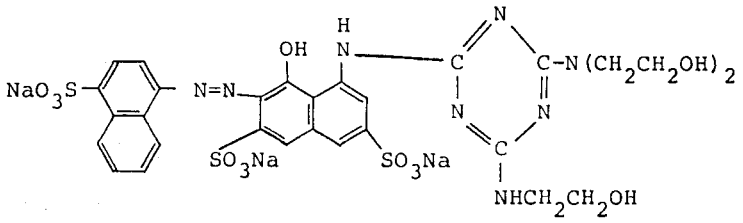

(2)

was spray-dried to form a powdery detergent (detergent B).

0.02 part of 3-methyl-2-benzothiazolinone-1'-hydroxy-2'-naphthoylhydrazone having the formula (3)

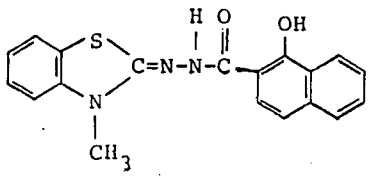

(3)

as a bluing dye precursor of this invention was mixed with 99.98 parts of the above spray-dried washing detergent composition A to form a powdery detergent (detergent C).

Hunter's L, *a* and *b* values, namely the brightness L and hues *a* and *b*, of these powdery detergents A, B and C were measured by a photoelectric color difference meter and their appearances were compared. The results are shown in Table 1.

Table 1

| Results of Color Measurement of Powdery Detergents | Detergent A | Detergent B | Detergent C |
|---|---|---|---|
| L value | 94.6 | 86.6 | 94.4 |
| a value | 0.5 | 4.6 | 0.5 |
| b value | 1.4 | −5.5 | 1.5 |

Notes

The "L" value indicates the brightness. As the *a* value increases in the positive number, the color becomes reddish, and as the *a* value increases in the negative number, the color becomes greenish. As the *b* value increases in the positive number, the color becomes yellowish and as the *b* value increases in the negative number, the color becomes bluish.

As is apparent from the above results, the detergent C of this invention has a whiteness comparable to that of the detergent A free of a bluing agent. In contrast, the detergent B containing the known bluing dye is colored in a reddish-violet hue and the brightness is low.

60 g of the respective detergents A, B and C was dissolved in 30 l of city service water in a washing machine, and a cotton fabric was washed at 25°C. for 10 minutes. After washing and discharge of the washing water, the fabric was rinsed in 5 minutes with city service water. Then, the washed fabric was ironed and dried outdoors under sun light. The above procedure was repeated 5 times. The fabrics washed with the above detergents A, B or C were compared with respect to their whiteness by a test panel of 50 men. The whiteness was evaluated based on naked eye observation. The results were as follows:

| | |
|---|---|
| Persons who judged that the fabric washed with detergent A was whitest | 0 |
| Persons who judged that the fabric washed with detergent B was whitest | 22 |
| Persons who judged that the fabric washed with detergent C was whitest | 28 |

Thus, it was confirmed that the detergent composition of this invention can impart to washed fabrics a bluing effect comparable or superior to that attained by a detergent containing a known bluing dye.

EXAMPLE 2

| | Detergent D (this invention) | Detergent E (comparison) |
|---|---|---|
| Sodium linear-alkylbenzenesulfonate (average carbon number of alkyl group being 12) | 17 parts | 17 parts |
| 3-(N-dodecyl-N,N-dimethylammonio)propane-1-sulfonate* | 3 parts | 3 parts |
| Sodium tripolyphosphate | 15 parts | 15 parts |
| Sodium silicate | 10 parts | 10 parts |
| Sodium carbonate | 3 parts | 3 parts |
| Sodium carboxymethyl cellulose | 1 part | 1 part |
| Soap | 1 part | 1 part |
| Fluorescent dye (same as used in Example 1) | 0.06 part | 0.06 part |
| Water | 10 parts | 10 parts |
| Bluing dye precursor** | 0.02 part | — |
| Potassium dichloroisocyanurate | 0.01 part | — |
| Sodium sulfate | 39.91 parts | 39.94 parts |

*amphoteric surface active agent having the formula

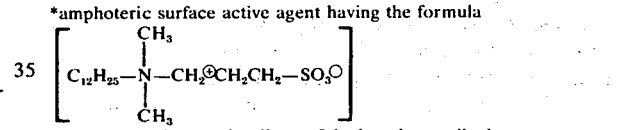

**3-methyl-2-benzothiazolinone-2-hydroxybenzoylhydrazone having the formula:

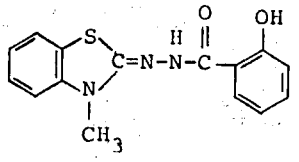

The powdery detergents D and E having the compositions indicated above were tested in the following manner.

60 g of the detergent was dissolved in 30 l of city service water in a washing machine, and a cotton fabric was washed at 25°C. for 10 minutes. After washing and discharge of the washing water, the fabric was rinsed for 5 minutes with city service water. The fabric was dried and the whiteness was evaluated based on the naked eye observation by 50 judges.

All of the 50 judges considered that the fabric washed with the detergent D of this invention was whiter than the fabric washed with the comparative detergent E. None of them judged that the fabric washed with the comparative detergent E was whiter.

As is apparent from the results of this Example, when an active halogen-generating agent such as potassium dichloroisocyanurate is used in combination with the bluing dye precursor, an excellent bluing effect can be attained just after washing.

EXAMPLE 3

| | Detergent F (this invention) | Detergent G (comparison) |
|---|---|---|
| Sodium linear-alkylbenzene-sulfonate (average carbon number in alkyl group being 12) | 15 parts | 15 parts |
| Polyoxyethylene (F=8) dodecyl ether | 5 parts | 5 parts |
| Sodium citrate | 20 parts | 20 parts |
| Sodium silicate | 10 parts | 10 parts |
| Sodium carbonate | 5 parts | 5 parts |
| Polyethylene glycol No. 6000 | 2 parts | 2 parts |
| Soap | 1 part | 1 part |
| Fluorescent dye (same as used in Example 1) | 0.06 part | 0.6 part |
| Water | 10 parts | 10 parts |
| Bluing dye precursor (same as used in Example 2) | 0.02 part | — |
| Sodium N-chloro-N-p-toluene-sulfonyl-3-aminopropane-sulfonate monohydrate | 0.05 part | — |
| Sodium sulfate | 31.87 parts | 31.94 parts |

Soiled pillow cases obtained from Japanese households were washed in the same manner as in Example 2 by using powder detergents having the compositions indicated above. After drying, the washed pillow cases were compared with respect to the whiteness by 50 judges based on the naked eye observation. 49 Judges considered that the pillow cases washed with detergent F of this invention were whiter, and 1 judge considered that both the pillow cases washed with the detergents F and G were comparable to each other with respect to the whiteness.

Thus, it was confirmed that an excellent effect is similarly attained when sodium N-chloro-N-p-toluenesulfonyl-3-aminopropane-1-sulfonate monohydrate is used as the active chlorine-generating agent.

EXAMPLE 4

| | Detergent H (this invention) | Detergent I (comparison) |
|---|---|---|
| Sodium alkylsulfate (average carbon number in alkyl group being 12) | 15 parts | 15 parts |
| Sodium nitrilotriacetate | 5 parts | 5 parts |
| Sodium tripolyphosphate | 15 parts | 15 parts |
| Sodium silicate | 5 parts | 5 parts |
| Sodium carbonate | 5 parts | 5 parts |
| Polyethylene glycol No. 6000 | 2 parts | 2 parts |
| Soap | 1 part | 1 part |
| Fluorescent dye (same as in Example 1) | 0.06 part | 0.06 part |
| Water | 10 parts | 10 parts |
| Bluing dye precursor* | 0.06 part | — |
| Oxone** | 0.1 part | — |
| Sodium chloride | 0.5 part | — |
| Sodium sulfate | 41.28 parts | 41.94 parts |

Notes

*1-ethyl-2-quinoline-2'-hydroxybenzoylhydrazone having the formula:

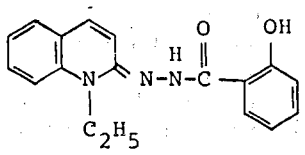

**: Tradename of DuPont for stabilized potassium persulfate having the following formula: $KHSO_4.KHSO_5.K_2SO_4$ Pillow cases were washed in the same manner as in Example 1 by using powdery detergents H and I having the compositions indicated above, and both the detergents were compared with respect to the whiteness of the washed pillow cases. As a result, 47 persons judged that the pillow cases washed with the detergent H of this invention was whiter and 3 persons judged that the pillow case washed with the comparative detergent I was whiter. Thus, it was confirmed that an excellent effect can be similarly attained when a mixture of Oxone and sodium chloride is used as an active chlorine-generating agent.

The embodiments of the invention in which an exclusive property or privilege is claimed are defined as follows:

1. A powder detergent composition for washing fabrics consisting essentially of a. from 0.001 to 0.5 percent by weight, based on the total weight of the detergent composition, of at least one bluing dye precursor having the formula

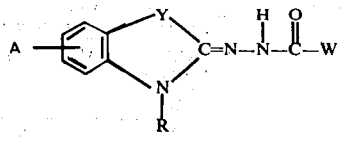

wherein A is hydrogen, chlorine, $-CH_3$, $-OCH_3$, $-SO_3H$ or $-SO_3Na$; Y is -S-, -O-,

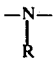

or -C=C-; R is methyl or ethyl; and W is

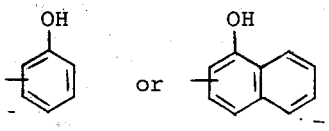

and b. the balance is water-soluble clothes-washing organic surfactant and water-soluble detergent builders.

2. A powder detergent composition as claimed in claim 1, containing from 0.002 to 0.1 percent by weight of ingredient (a).

3. A powder detergent composition as claimed in claim 1, in which said precursor is selected from the group consisting of 3-methyl-2-benzothiazolinone-1'-hydroxy-2'-naphthoylhydrazone, 1-ethyl-2-quinolinone-2'-hydroxybenzoylhydrazone, 1,3-dimethyl-2-benzimidazolone-1′-hydroxy-2′-naphthoylhydrazone, 3-methyl-2-methylbenzoxazolone-2′-hydroxybenzoylhydrazone, 3-methyl-2-benzothiazolinone-2′-hydroxybenzoylhydrazone, x-sulfo-3-methyl-2-benzothiazolinone-1′-hydroxy-2′-naphthoylhydrazone, 3-methyl-2-benzothiazolinone-2′-hydroxy-3′-naphthoylhydrazone, 5-chloro-3-methyl-2-benzothiazolinone-1′-hydroxy-2′-naphthoylhydrazone, 1,3,5-trimethyl-2-benzimidazolone-1′-hydroxy-2′-naphthoylhydrazone, 1-ethyl-6-methoxy-2-quinoline-2′-hydroxy-benzoylhydrazone.

4. A powder detergent composition for washing fabrics consisting essentially of a. from 0.001 to 0.5 percent by weight, based on the total weight of the detergent composition, of at least one bluing dye precursor having the formula

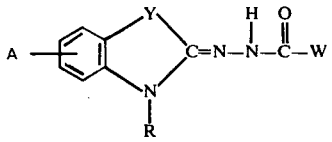

wherein A is hydrogen, chlorine, $-CH_3$, $-OCH_3$, $-SO_3H$ or $-SO_3Na$; Y is -S-, -O-,

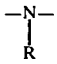

or -C=C-; R is methyl or ethyl; and W is

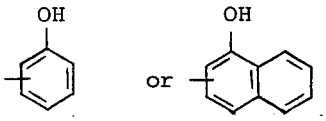

b. from 0.001 to 1.0 percent by weight, based on the total weight of the detergent composition, of at least one water-activated, active-halogen generating agent capable of generating an active halogen when dissolved in water selected from the group consisting of N-halogenated isocyanuric acid salts, N-halogenated succinimides, N-halogenated phthalimides, N-halogenated acetanilides, N-halogenated benzamides, N-halogenated benzenesulfonamides, N-halogenated toluenesulfonamides, N-halogenated N-arylsulfonyl-3-aminopropane-1-sulfonic acid salts, N-halogenated N-alkylsulfonyl-3-aminopropane-1-sulfonic acid salts, and a mixture of potassium persulfate and sodium chloride, and c. the balance is water-soluble clothes-washing organic surfactant and water-soluble detergent builders.

5. A powder detergent composition as claimed in claim 4, containing from 0.002 to 0.1 percent by weight of ingredient (a) and from 0.005 to 0.5 percent by weight of ingredient (b).

6. A powder detergent composition as claimed in claim 4, in which said precursor is selected from the group consisting of 3-methyl-2-benzothiazolinone-1′-hydroxy-2′-naphthoylhydrazone, 1-ethyl-2-quinolinone-2′-hydroxybenzoylhydrazone, 1,3-dimethyl-2-benzimidazolone-1′-hydroxy-2′-naphthoylhydrazone, 3-methyl-2-methylbenzoxazolone-2′-hydroxybenzoylhydrazone, 3-methyl-2-benzothiazolinone-2′-hydroxybenzoylhydrazone, x-sulfo-3-methyl-2-benzothiazolinone-1′-hydroxy-2′-naphthoylhydrazone, 3-methyl-2-benzothiazolinone-2′-hydroxy-3′-naphthoylhydrazone, 5-chloro-3-methyl-2-benzothiazolinone-1′-hydroxy-2′-naphthoylhydrazone, 1,3,5-trimethyl-2-benzimidazolone-1′-hydroxy-2′-naphthoylhydrazone, 1-ethyl-6-methoxy-2-quinoline-2′-hydroxy-benzoylhydrazone.

* * * * *